United States Patent [19]

Guercio

[11] 4,253,502

[45] Mar. 3, 1981

[54] CARBONATED BEVERAGE BOTTLING APPARATUS

[75] Inventor: Salvatore P. Guercio, Dix Hills, N.Y.

[73] Assignee: Universal Packaging Machinery Sales Corp., Dix Hills, N.Y.

[21] Appl. No.: 52,027

[22] Filed: Jun. 25, 1979

[51] Int. Cl.[3] ..... B65B 31/02

[52] U.S. Cl. ..... 141/47; 141/59; 141/63

[58] Field of Search ..... 141/1, 4–7, 141/37, 39, 59, 40–58, 60–70, 100–107, 290–304, 305–310, 392

[56] References Cited

U.S. PATENT DOCUMENTS 3,212,537 10/1965 Hinxlage et al. ..... 141/6

*Primary Examiner*—Houston S. Bell, Jr.

*Attorney, Agent, or Firm*—Bauer & Amer

[57] ABSTRACT

Carbonated beverage is bottled without foaming, even though at a comparatively elevated temperature (i.e. 55°–60° F.), by confining it, as it fills each bottle, between an incoming fluid pressure and a displaced air outgoing pressure of a sufficient extent to prevent release of the carbon dioxide content thereof. Further, said two just referred to pressures are maintained in balanced relation, so as not to impede the flow rate of the beverage, and thereby to contribute to a commercially acceptable bottling rate.

3 Claims, 4 Drawing Figures

CARBONATED BEVERAGE BOTTLING APPARATUS

The present invention relates to bottling apparatus for carbonated beverage, and more particularly to improvements readily applied to existing bottling apparatus which enables the operation thereof at an acceptable bottling rate, even with beverage that may be "warm".

The incentive to "warm fill" carbonated beverage is of particular importance currently, because of obvious savings in energy. Prior art practice dictates refrigerating the beverage preparatory to bottling, so that even a nominal ambient pressure will prevent release or foaming of the carbon dioxide content thereof. However, proper preparation for warehouse storage of the bottled beverage dictates warming it at least to the prevailing ambient temperature, in order to avoid water condensation on the bottles, absorption thereof by the cardboard storage cartons, and the ultimate collapse of these cartons and toppling of the vertical stacks of the stored product. Heretofore it has not been possible to effectively bottle a carbonated beverage in its appropriate condition for warehouse storage, i.e. when "warm", and thus obviate the waste in cost and energy of the temporary refrigeration thereof merely to control foaming at the bottle-filling station.

Broadly, it is an object of the present invention to provide improved bottling apparatus for "warm filling" carbonated beverages overcoming the foregoing and other shortcomings of the prior art. Specifically, it is an object to provide a bottling procedure which contemplates confining the carbonated beverage actually between two foam-preventing pressures, at the critical time during which it is being urged through movement filling the bottles, thus enabling the bottling apparatus having this operational mode to effectively "warm fill" carbonated beverages at an acceptable, reasonably rapid rate.

Improvements in bottling procedures demonstrating objects and advantages of the present invention are advantageously applied to apparatus of the type in which replenishment of the carbonated beverage supply in a closed storage container is made by the flowing of the carbonated beverage through an inlet conduit having a normally open pressure-operated valve, said incoming beverage thereby restoring the depleted level of the carbonated beverage until a selected elevated level in said storage container is reached at which a gaseous pressure source then causes the closing of said valve. The improvements to said apparatus enabling the bottling of the carbonated beverage at an elevated temperature includes discharge conduit means connected from the storage volume of the carbonated beverage in the storage container to an operative arrangement of hollow bottles at the filling station awaiting filling. Bottle-venting conduit means at the bottling station are operationally disposed in communication at opposite ends with the hollow interior of a cooperating bottle and with the unfilled portion of the carbonated beverage storage container during the filling of each bottle. As a consequence, and preferably using the same gaseous pressure source for operating the valve controlling the volume of stored beverage, said gaseous pressure medium in its location in the head space or upper portion of said storage container is also effectively exerted upon the carbonated beverage filling each bottle by virtue of contact therewith in a reverse direction through the bottle-venting conduit means. Meanwhile pump means advantageously located in the inlet conduit to the storage container is operatively effective to pump the carbonated beverage at a selected pressure during the replenishment of the supply thereof in said storage container. Thus, the carbonated beverage filling a bottle is effectively under the pressure influence of the pump means at the bottle inlet and under the pressure influence of the pressurized gas at the bottle outlet, and thus is maintained stable in relation to its carbon dioxide content even though at an elevated temperature of perhaps 55°–60° F.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 2:
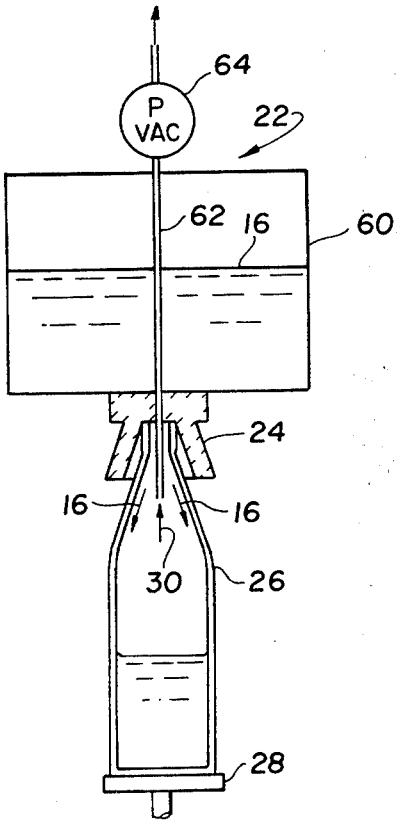
FIG. 2 PRIOR ART
FIG. 2 is a front elevational view illustrating in greater detail the bottling station of said prior art apparatus and, more particularly, the conditions affecting the stability of the carbonated beverage during filling.
Figure 3:
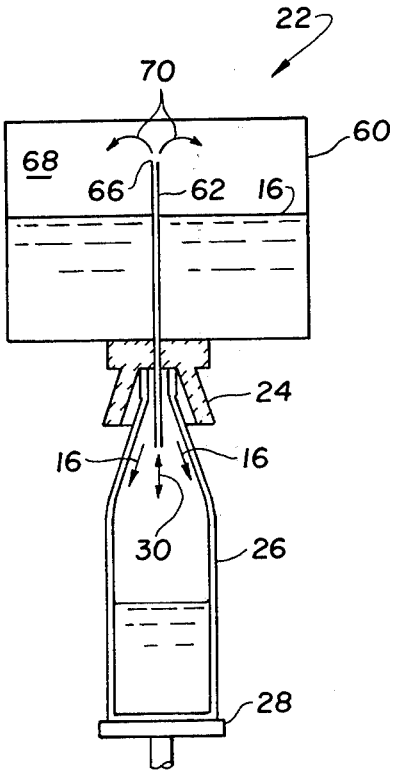
Figure 4:
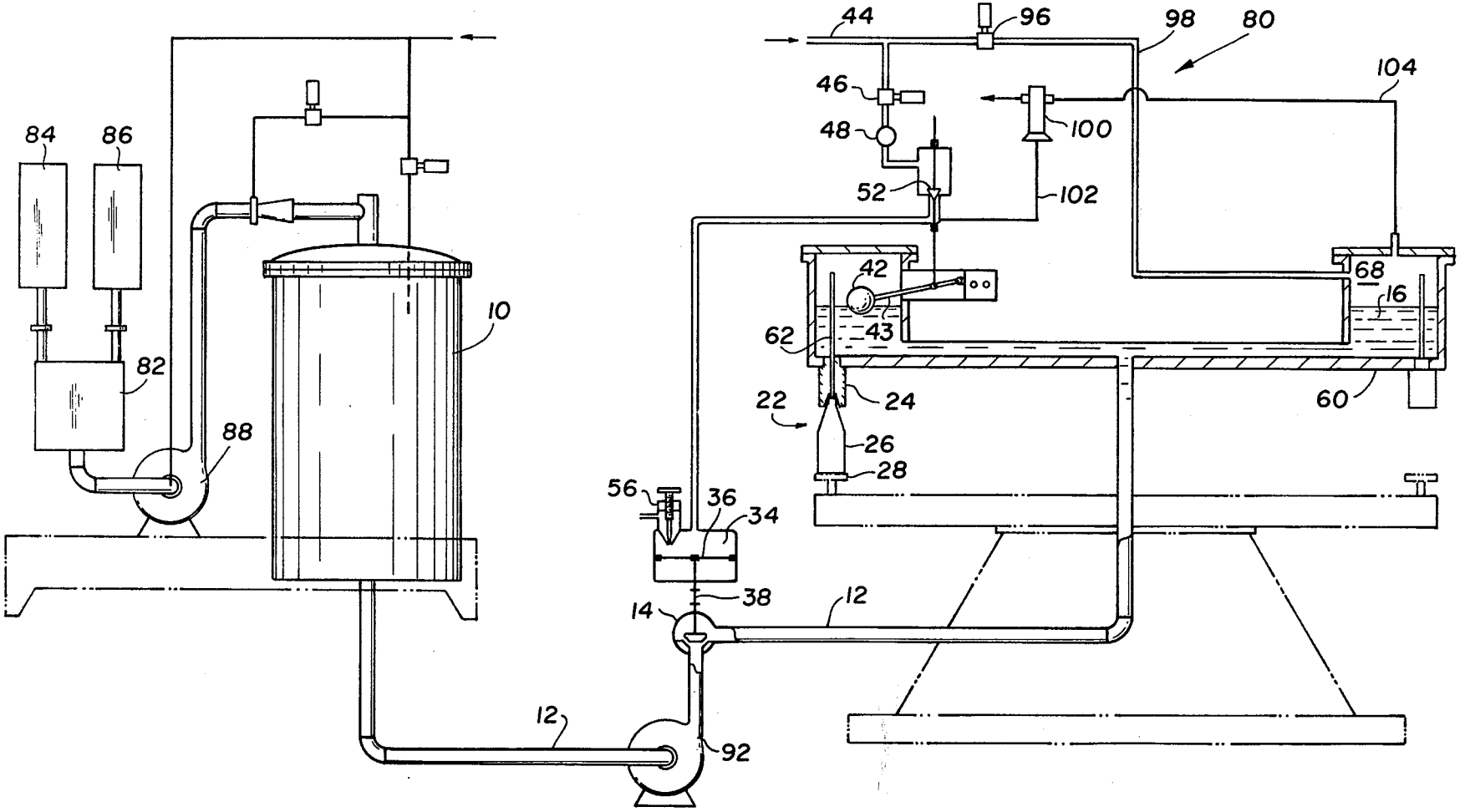

FIG. 3 is a detailed front elevational view intended to be contrasted with FIG. 2 so as to illustrate those operating conditions imposed on the carbonated beverage during filling which maintain the stability thereof and which are not available under said prior art set-up of FIG. 2; and FIG. 4 is a front elevational view, which is partly schematic and partly diagrammatic, which effectively illustrates the operational mode of the within improved carbonated beverage bottling apparatus.

A typical carbonated beverage, such as a cola drink, containing 3.8 volumes of carbon dioxide per liquid volume would, at an elevated temperature such as 55 to 60 degrees F., require confinement under a pressure of perhaps 45 pounds per square inch in order to maintain the carbon dioxide content thereof in a stabilized condition. That is, if the pressure containing the carbonated beverage was significantly less than 45 per square inch, it would "foam" in the temperature range noted. On the other hand, it is well known that a refrigerated carbonated beverage can be effectively stabilized at a significantly reduced pressure. The reaction of the carbonated beverage under the pressure and temperature conditions as just noted is, of course, significant in the operation of any bottling apparatus, since a carbonated beverage cannot be bottled while "foaming".

It has heretofore been the practice to chill or refrigerate the carbonated beverage so that it can be effectively bottled under nominal pressure. However, before such refrigerated bottled beverage can be stored in a typical warehouse, in which the ambient temperature during the warm seasons of the year may be quite high, it must be heated to approximately the prevailing ambient temperatures or else water moisture will condense on the surfaces of the bottles, be absorbed into the cardboard containers in which the bottles are normally stored, and this ultimately will lead to rupture of these containers, and thus the collapse of any vertical stacking of these containers. The unnecessary cost and energy wasted in this prior art procedure is self-evident, since the initial condition of the carbonated beverage in which it is "warm" would also be a suitable condition for storage in a warehouse, and thus obviating the need to refrigerate the beverage in order to effectuate the bottling thereof without foaming would result in significant savings.

In accordance with the present invention, by maintaining operating parameters as will be described in more detail subsequently, it is possible to effectively bottle a typical carbonated beverage while it is relatively "warm", as for example at about 55 to 60 degrees F. which, for all practical purposes, thereby obviates any need to chill or refrigerate the beverage. Moreover, the bottling of the "warm" carbonated beverage is performed at a filling speed which is comparable to that prevailing when using a refrigerated or chilled beverage. By way of example, using conventional commercially available bottling apparatus with 80 filling valves, it is possible to fill 160 two-liter volume bottles per minute which, it will be readily recognized, is an acceptable filling speed for a refrigerated carbonated beverage. This is significant since it demonstrates that the solution to the "foaming" problem achieved by the within invention is not the result of merely imposing a significant counter-pressure on the carbonated beverage as it enters into and fills the bottle. Such counter-pressure would, of course, impede the flow rate of the beverage into the bottle and would therefore slow down the filling speed to an impractical rate.

Figure 1:
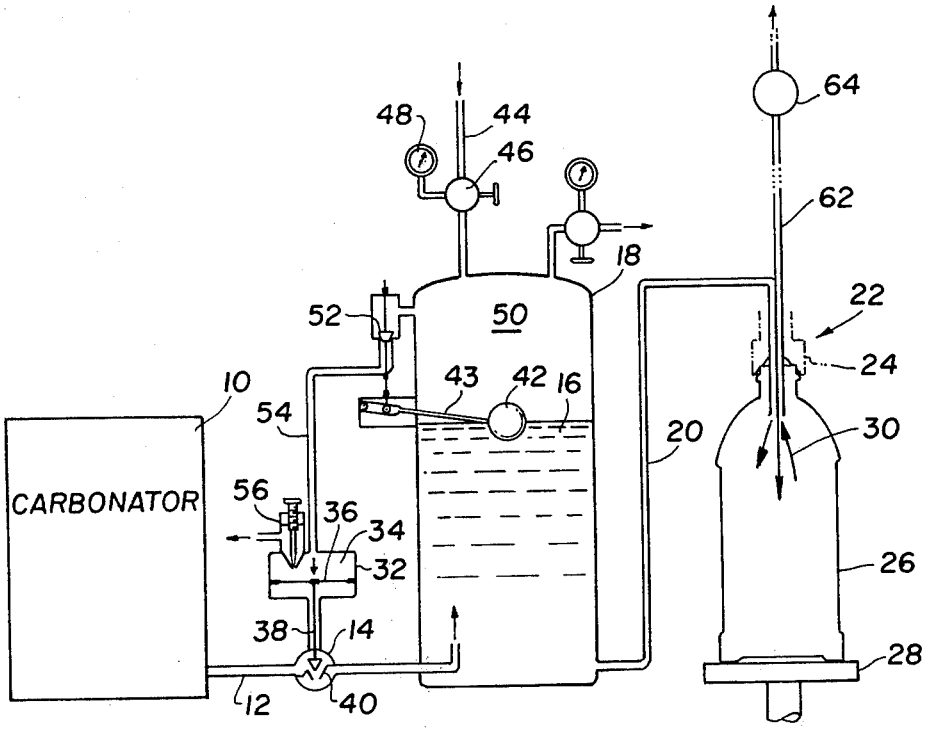
FIG. 1 PRIOR ART
FIG. 1 is a simplified diagrammatic view of a prior art carbonated beverage bottling apparatus.

As helpful background to understanding the contribution of the within invention, reference should be made to the simplified schematic of a prior art bottling apparatus illustrated in FIG. 1. Said FIG. 1 apparatus is essentially the apparatus illustrated and described in the prior KARR U.S. Pat. No. 3,832,474. As understood, a typical carbonated beverage, such as a cola drink, is produced in a mixing tank 10, commonly referred to as a "carbonator". The carbonated beverage exits from the carbonator 10 under pressure through a conduit 12, passing in the process through an intermittently operated valve 14, and in this way replenishes a supply of the carbonated beverage being maintained within a storage tank 18. A conduit connection 20 is effective in permitting the carbonated beverage to flow from tank 18 to a bottle filling station 22, at which station it will be understood that there may be any one of many available bottle filling and sealing machines, the major component of which, as is well understood, is a so-called filler bowl. For present purposes it suffices to note that said filler bowl includes plural filling valves 24 which each descend from a clearance position to an operative position, as illustrated in phantom perspective in FIG. 1, in which it effectively makes contact about an opening of a bottle 26 preparatory to the filling thereof. The referred to bottle is moved into position on an appropriate conveyor 28. Next, the filler bowl filling valve 24 and conveyor 28 move in unison for a sufficient period of time to enable the carbonated beverage being introduced into the bottle 26, as represented by the arrow 16, to entirely fill the bottle, such incoming fluid displacing the air 30. Eventually, as is well understood, the filling valve 24 assumes an elevated position, and bottle 26 filled with the carbonated beverage 16 is appropriately sealed.

An operating parameter required for a typical prior art bottling apparatus, as exemplified by the apparatus of FIG. 1, as well as for the bottling apparatus of the within invention, is the need to replenish, from time to time, the carbonated beverage supply 16. To this end, the prior art apparatus of FIG. 1 includes a valve housing 32 which bounds a pressure chamber 34 for a diaphragm 36 to which the movable valve member 38 is connected in depending relation so as to assume an opened or closed condition with respect to a valve seat 40. The two operating conditions of valve 14 are those which either permit or terminate flow of the carbonated beverage into the storage tank 18, and which of these two occurs is a function of a float 42. More particularly, and as is well understood, storage tank 18 is connected to a suitable pressure source, which could be pressurized carbonated dioxide or air, via a conduit 44 which includes a pressure regulator 46 and pressure gauge 48. The gaseous pressure medium, as just referred to, fills head space 50 of tank 18 and, it should be noted, is effective in maintaining the carbonated beverage supply 16 under pressure sufficient to prevent foaming. Assuming a larger supply of the carbonated beverage than that illustrated, and thus a level thereof which is correspondingly higher than that illustrated, float 42 will also be at an elevated condition in which float arm 43 will partake of a pivotal traverse which will lift valve 52 from its cooperating valve seat and permit the gaseous pressure fluid in head space 50 to flow through conduit 54 and into pressure chamber 34. The effect of this is to produce descending movement in the diaphragm 36 which, in turn, closes valve 14. Thus the supply of carbonated beverage in tank 18 is cut off while the storage volume 16 thereof is used for filling bottles 26 at the filling station 22. Ultimately this will diminish the storage volume 16 to the condition illustrated in FIG. 1, in which float 42 is at a level which results in the seating of valve 52 and the cut off of the gaseous pressure medium in head space 50 from chamber 34. Chamber 34 meanwhile has a so-called "bleed" valve 56 connected to it, which effectively exhausts the pressure of chamber 34 to atmosphere, and thus ultimately results in the pressure in chamber 34 assuming a diminished value which will result in the opening of valve 14. This again repeats the cycle in which the carbonated beverage pressure flows from the carbonator 10 into the storage tank 18 until an elevated level of the storage supply 16 is reached again opening valve 52, and correspondingly results in the closing of valve 14.

In the operation of bottling apparatus according to prior art practice, and more particularly, in regard to the requirement of replenishing, from time to time, the carbonated beverage supply at the filling station 22 preparatory to the filling of bottles at said station, the satisfying of this requirement has been achieved independently of the requirement of minimizing foaming at the filling station. This is perhaps best demonstrated by the simplified diagrammatic view of the prior art practice at filling station 22 as shown in FIG. 2. Individual bottles 26 supported on conveyor 28 in filling relation to each filling valve 24 will typically have carbonated beverage 16 introduced for gravity flow down along the sides of the bottle, said carbonated beverage being supplied from a supply volume 16 thereof of a conventional filler bowl 60. The air 30 being displaced from within each bottle 26, without which displacement the carbonated beverage 16 will not flow into the bottle, is removed via a conduit 62 which optionally can merely exhaust to atmosphere or can have an operative connection to a vacuum pump 64, all as is noted in the referred to KARR U.S. Pat. No. 3,832,474. As a result, as the carbonated beverage 16 fills each bottle 26, there is no effective pressure maintained thereon to minimize the release of the carbon dioxide content thereof and thus to prevent "foaming".

To facilitate comparison of the operating parameters effectively maintained at the filling station 22 in accordance with the present invention in which, as will be more readily apparent as the description proceeds, such parameters effectively prevent any "foaming" in the carbonated beverage, reference should be made to FIG. 3 in which parts of the apparatus similar to those already described in FIG. 2 are designated by the same reference numerals. In contrast to the prior art practice as just described, the operating conditions or parameters at filling station 22 according to the present invention include the carbonated beverage supply 16 being also fed from filler bowl 60 so as to produce the flow represented by the arrows 16 down along the inside surface of a bottle 26 which is in position on conveyor 28 and in filling relation to the filling valve 24. However, the venting conduit or tube 62 for such bottle terminates not in a connection to a vacuum pump or in a location venting the displaced air 30 to atmosphere, but rather communicates, as at 66, with what will be understood to be a pressurized head space 68 of the filler bowl. In a sense, therefore, although the flow of the displaced air is in the direction of the arrow 70, to the extent that head space 68 is occupied by a gaseous pressure medium which, in this instance will be understood to be either carbon dioxide or air at 45 pounds per square inch, there is also being exerted in a reverse direction through the tube 62 a counter-pressure on the fluid 16 filling the bottle 26 by said gaseous pressure medium. To indicate that in addition to the directional movement of the displaced air 30 there is also exerted on this displacing air a pressure which correspondingly is also exerted on the carbonated beverage 16 filling the bottle 26, the reference numeral 30 is associated with a double-headed arrow. Stated another way, underlying the present invention is the recognition that two pressures effectively minimizing foaming can be exerted on the carbonated beverage filling the bottle 26, one such pressure being exerted or applied through the venting tube 62, and the other applied directly on the entering carbonated beverage flow 16 flowing down the sides of the bottle 26. In the circumstances depicted in FIG. 3, the selected pressure for the entering carbonated beverage 16 is also approximately 45 pounds per square inch, and is applied in a manner as subsequently described in greater detail herein.

From the foregoing it should therefore be noted that the operating parameters or conditions at the filling station 22 as depicted in FIG. 3 are, according to the present invention, conditions in which the inflowing carbonated beverage 16 is approximately at 45 pounds per square inch as is also the air 30 being displaced by this fluid from each bottle 26. In effect, therefore, the carbonated beverage 16 entering the bottle 26 has an inlet pressure and an outlet pressure, between which it is effectively contained, of approximately 45 pounds per square inch. Such pressure imposed upon the carbonated beverage will be readily recognized by those well versed in the art as being adequate to stabilize and prevent foaming in a carbonated beverage of 3.8 volumes of carbon dioxide per liquid volume even at a temperature of between 55 and 60 degrees F. Moreover, it will be further recognized that since the incoming and outgoing pressure is approximately at the same selected value of 45 pounds per square inch, that there is no interference with the rate of flow of the air 30 being displaced from each bottle 26. That is, the opposing pressures which affect the rate at which the carbonated beverage fills each bottle 26 and the rate at which the air it displaces leaves same, are effectively in balance, and this in practice has been found to contribute to an effective rate of filling of the bottles at filling station 22.

IMPROVED BOTTLING APPARATUS

Reference is now made to FIG. 4 in which in diagrammatic and somewhat simplified form there is illustrated a bottling apparatus, generally designated 80, which by its construction and operational mode is effective in bottling carbonated beverage at a speed which is comparable to the bottling rate of a refrigerated carbonated beverage but without the need for such refrigeration, and in the operation of which there is little or no foaming of the carbonated beverage at the bottling station. To demonstrate how the improvements according to the present invention are effectively applied to existing bottling apparatus, the structural features and components of exiting bottling apparatus similar to those already described are designated by the same reference numerals. Referring to FIG. 4, said apparatus is operatively associated with a carbonator 10 having a mixing tank 82 into which the fluid contents 84 and the carbon dioxide contents 86 are delivered for mixing, and after which the mixture is delivered via pump 88 to the carbonator 10. The carbonated beverage of the carbonator 10 is sucked therefrom via conduit 90 by a pump 92, which it will be understood is effective in urging the carbonated beverage at a selected pressure, in this instance approximately 45 pounds per square inch, through the continuation of conduit 12 on the high pressure side of the pump 92 into the filler bowl 60, such that there is a ready supply of the carbonated beverage 16 in said filler bowl at the just noted fluid pressure of approximately 45 pounds per square inch. Situated on the high pressure side of pump 92 is valve 14 having a depending movable valve member 38 affected by the pressure condition within the valve chamber 34 adjacent the diaphragm 36 of the valve. As already noted, the opened or closed condition of valve 14 is a function of the operation of bleed valve 56, valve 52 and float 42. That is, in the condition as depicted in FIG. 4, valve 14 is open and pump 92 is then effective in pumping carbonated beverage at a pressure of 45 pounds per square inch through valve 14 into the filler bowl 60. This raises float 42 until there is a pivotal traverse in arm 43 thereof sufficient to open valve 52, to thus allow a surge of a gaseous pressure medium of 45 pounds per square inch, which may be either carbon dioxide or air, through the open valve 52 and through conduit 54 into chamber 34. This closes off valve 14, terminating the flowing of carbonated beverage by the pump 92 to replenish the supply thereof in filler bowl 60. This replenishing of the supply 16 does not again resume until float 42 descends to the point where valve 52 is closed and bleed valve 56 exhausts the pressure of chamber 34 to that point at which the moving valve 38 is again unseated from the valve seat within valve 14.

As already noted, 45 pounds per square inch gaseous pressure medium for use in controlling the manner in which the carbonated beverage supply 16 is replenished in the filler bowl 60 is obtained from a suitable source 44, and is delivered through an appropriate pressure regulator 46 under observation using a pressure gauge 48. In accordance with the present invention, it is also contemplated that this same 45 pounds per square inch gaseous pressure source will be channeled through a pressure regulator 96 and through a vertically oriented length segment 98 of a conduit which in position coincides with the rotational axis of the filler bowl 60, and thence through a continuation of said conduit directly into the head space 68 of the filler bowl 60. In practice therefore, the gaseous pressure source 44 should be filtered air or carbon dioxide. In this manner, the gas in the head space 68 of filler bowl 60 is maintained at 45 pounds per square inch, and thus is in balance with the fluid pressure of the carbonated beverage supply 16 which is supplied at that same pressure by pump 92 during intermittent operation or throttling of valve 14 in the conduit 12 connected between the pump 92 and filler bowl 60. As a result of this pressure balance, each individual bottle 26 carried by the rotating turntable or conveyor 28 into filling position at filling station 22 of the apparatus 80, and thus carried into filling relation to a cooperating filling valve 24, is effectively filled at a commercially acceptable fast rate with the carbonated beverage at a temperature of approximately 55 to 60 degrees F., and thus without being needlessly prepared by a refrigeration process for bottling in order to obviate foaming.

For completeness'0 sake, it is noted that additional structure embodied by the within improved apparatus 80 that is not part of the apparatus already described includes a vent valve 100 having connections 102 and 104 to the compartments 34 and 68, respectively, so that these compartments can be vented in the event that they become over-pressurized.

From the foregoing description it should be readily appreciated that there has been described herein an improved bottling apparatus 80 for carbonated beverage that with a nominal addition of structural features is nevertheless effectively operated so that there is no foaming of the carbonated beverage at the filling station 22, even though the carbonated beverage is at an elevated temperature of approximately 55 to 60 degrees F., and wherein the filling rate is comparable to the rate at which a refrigerated carbonated beverage is capable of being bottled. In the foregoing description, a number of the structural components have been illustrated in greatly simplified form since their construction and operational mode is well understood. For example, the filler bowl 60 is a component of conventional bottling, filling and sealing machinery available for the beverage industry from numerous commercial sources, one such source being Uni-Pack Corp. of Longwood, Fla. From this same source, as well as other commercial sources, it is also readily possible to obtain any number of carbonators, as exemplified by carbonator 10, which can be effectively utilized to provide the advantages of the within invention. Also, sealing valves, as exemplified by valve 24, are readily available from numerous commercial sources, and are constructed and have an operational mode which is well understood, and therefore have not been described in detail herein. One such source for this component is Holstein & Kappert Maschinenfabrke Phoenix GMBH of Dortmund, West Germany.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. In the bottling of a carbonated beverage using apparatus of the type in which replenishment of the supply thereof in a closed storage container is made by the flowing of said carbonated beverage through an inlet conduit having a normally open pressure-operated valve and thereby restoring the depleted level of said carbonated beverage to a selected elevated level in said storage container at which a gaseous pressure source then causes the closing of said valve, the improvements to said apparatus enabling the bottling of said carbonated beverage at an elevated temperature, said improvements comprising discharge conduit means connected from said storage volume of said carbonated beverage in said storage container to an operative arrangement of hollow bottles incident to the filling thereof, bottle-venting conduit means operationally disposed in communication at opposite ends with the hollow interior of a cooperating bottle and the unfilled upper portion of said carbonated beverage storage container during said filling of said bottle, an operative connection to a gaseous pressure source for effectuating the prior delivery of said pressurized gas into said upper portion of said storage container for exerting a selected pressure upon said carbonated beverage filling said bottle through said bottle-venting conduit means, and pump means in said inlet conduit to said storage container downstream of said valve operatively effective to pump said carbonated beverage at approximately said same selected pressure of said gaseous pressure source through said valve in said open condition thereof during said replenishment of the supply thereof in said storage container, whereby said carbonated beverage filling a bottle is effectively under the pressure influence of said pump means at the bottle inlet and under the pressure influence of said pressurized gas at the bottle outlet and thus is maintained stable in relation to its carbon dioxide content even at said elevated temperature, and said pressures being selected to be approximately the same are effective to contribute to an optimum fast flowing rate in the carbonated beverage during the filling of said bottles.

2. The improved carbonated beverage bottling apparatus as claimed in claim 1 wherein said gaseous pressure source at said selected value is also used to periodically actuate said pressure-operated valve into said closed condition incident to terminating said replenishment of said supply of said carbonated beverage, whereby more effective control over the opening and closing of said valve is achieved using said known value of pressurized gas.

3. The improved carbonated beverage bottling apparatus as claimed in claim 2 wherein said temperature of said carbonated beverage is in the range of 55 to 60 degrees F., and said pressure in said carbonated beverage produced by said pump means and of said gaseous pressure source is approximately 45 pounds per square inch, to thereby contribute to the filling of bottles with said carbonated beverage with nominal loss of the carbon dioxide content thereof.

* * * * *